US005688635A

United States Patent [19]

Parker et al.

[11] Patent Number: 5,688,635

[45] Date of Patent: Nov. 18, 1997

[54] TONING OF PHOTOGRAPHIC PRINT MATERIAL

[75] Inventors: Michael John Parker, Holmes Chapel, Great Britain; Anthony Martin Lannon, Stockport, England

[73] Assignee: Ilford Limited, England

[21] Appl. No.: 643,683

[22] Filed: May 6, 1996

[30] Foreign Application Priority Data

May 13, 1995 [GB] United Kingdom ..... 9509757

[51] Int. Cl.[6] ..... G03C 5/305

[52] U.S. Cl. ..... 430/464; 430/268; 430/486

[58] Field of Search ..... 430/464, 480, 430/483, 486, 487, 490, 268; 562/45, 437; 564/18

[56] References Cited

U.S. PATENT DOCUMENTS

| | | | |
|---|---|---|---|
| 2,396,156 | 3/1946 | Clarkson | 564/18 |
| 3,615,512 | 10/1971 | Ducrocq et al. | 430/486 |
| 5,380,624 | 1/1995 | Yoshida et al. | 430/490 |
| 5,384,232 | 1/1995 | Bishop et al. | 430/483 |
| 5,503,965 | 4/1996 | Okutsu | 430/483 |

FOREIGN PATENT DOCUMENTS

| | | | |
|---|---|---|---|
| 1174103 | 1/1965 | Germany | 564/18 |
| 9621886 | 7/1996 | WIPO . | |

*Primary Examiner*—Hoa Van Le
*Attorney, Agent, or Firm*—Ostrager, Chong & Flaherty

[57] ABSTRACT

There is described a photographic developing solution which comprises as an image toning agent a compound of formula I:

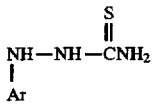

where Ar is an aromatic or heteroaromatic ring which may be substituted, in a concentration of at least 0.00035 moles/liter.

11 Claims, No Drawings

TONING OF PHOTOGRAPHIC PRINT MATERIAL

BACKGROUND OF THE INVENTION

This invention relates to the toning of black and white photographic prints. The term toning relates to the process wherein the normal neutral grey black and white print image is either converted or is caused to form as an image which has a colour which is not neutral grey. In a number of toning processes the silver image after development is converted to a non-silver image. For example in sepia toning after formation of the silver image the image is converted to a silver sulphide image which is of a sepia colour. However, in another type of toning the silver image is caused to form in such a way that it reflects light to cause the resultant image either to be on the warm side of neutral, that is to say the image is slightly brownish or to be on the cold side of neutral that is to say the image is slightly bluish. These colour changes are rather subtle compared with the colour changes which occur when the silver image is replaced by the image of another substance, for example silver sulphide, in which case a very definite brown image is obtained.

This invention relates to the production of cold toned black and white print material during the development step. In the past various substances have been added either to the developing solution or to the photographic material itself which result in a cold toned silver image of the print. However, it has been found to be difficult to reproduce in a reliable manner the cold toning effect and further that the presence of such substances during the photographic development often cause undesirable sensitometric side effects such as changes in speed or contrast or an increase in fog of the developed material. Also some such substances have been found to give undesirable green tones to print material.

We have found a photographic developing solution for cold toning photographic black and white material which yields reliable results and which does not cause undesirable photographic side effects.

DETAILED DESCRIPTION OF THE PREFERRED EMBODIMENTS

Therefore, according to the present invention there is provided a photographic developing solution which comprises as an image toning agent a compound of formula I:

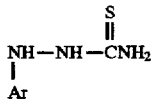

I where Ar is an aromatic or heteroaromatic ring which may be substituted, in a concentration of at least 0.00035 moles/liter. Compounds of formula I are known compounds or may be prepared by known methods, for example by reaction of a substituted hydrazine Ar NH $NH_2$ with potassium thiocyanate.

Preferably the aromatic ring is a phenyl ring, which is substituted with a water solubilising group such as a carboxylic or sulphonic acid group or a salt thereof.

Most preferably the compound of formula I has the formula II:

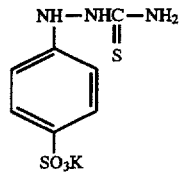

II

This is the compound which is used in the examples which follow and is hereinafter referred to as compound A.

Suitable developing agents in the developing solutions of this invention are dihydroxy benzene and reductone type developing agents.

Examples of reductone type developing agents are reductone itself which is of the formula HOCH=COHCHO and other compounds which comprise the group —CO—CHOH— or its taummeric form —COH=COH— such as dihydroxyacetone, tetramethyl reductic acid or ascorbates of the general formula III:

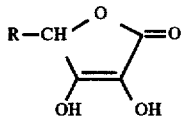

III or alkali metal salts thereof wherein R represents a hydroxylated alkyl group, or compounds of general formula IV:

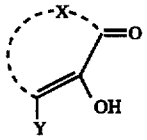

IV where X represents the atoms necessary to complete a ring system and Y is a secondary amine group.

Y in formula IV is preferably a cyclic amine for example morpholine or piperidine.

An example of a particularly useful reductone of formula IV is the compound of formula V:

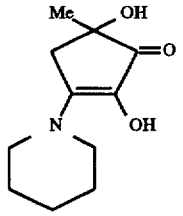

V

This compound has the trivial name of piperidino-hexose reductone.

Preferred ascorbates of general formula III for use in the present invention include L-ascorbic acid, D-isoascorbic acid and L-erythroascorbic acid. Salts of such compounds may also be used.

Examples of dihydroxybenzene type developing agents are hydroquinone, t-butyl hydroquinone, methyl hydroquinone, dimethyl hydroquinone, chloro hydroquinone, bromohydroquinone, hydroquinone monosulphonate, hydroquinone disulphonate, and gentisic acid.

Preferably the amount of dihydroxybenzene developing agent or ascorbate developing agent present in the working strength photographic developing solution is from 1 to 15 g/liter.

There is also present in the solutions of the invention an electron transfer agent. By electron transfer agent is meant a compound which acts synergistically with a reductone type developing agent or hydroquinone type developing agent to provide an active relatively long lasting developing combination. A large number are known from the patent literature but in practice the most commonly used ones are aminophenols such as p-methylaminophenol which is known commercially as Metol and pyrazolidinone compounds of general formula VI:

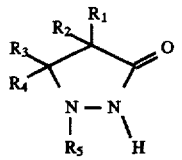

VI in which $R_5$ is an aromatic ring, $R_1$ and $R_2$ are hydrogen, lower alkyl, or hydroxy alkyl, and $R_3$ and $R_4$ are hydrogen, lower alkyl or phenyl. By lower alkyl is meant an alkyl group with up to 3 carbon atoms.

Preferably $R_5$ is phenyl or a substituted phenyl such as 4-methyl phenyl or 4-chloro-phenyl.

A particularly preferred compound for use in the developing solution of this aspect of the present invention is 1-phenyl-4-methyl-4-hydroxymethyl pyrazolid-3-one which is hereinafter referred to as compound B.

Preferably the mount of electron transfer agent present in the working strength developing solution is from 0.1 to 1.5 g/liter, and most preferably from 0.2 to 0.8 g/liter.

There is also present in the developing solution at least one basic compound, such as a salt of hydroxide, carbonate, or sulphite.

It is preferred to include salts of both sulphite and carbonate, the sulphite as a basic compound, as an antioxidant and as a development accelerator (noted in U.S. Pat. No. 5,098,819) and the carbonate as a basic compound and as a buffer in the developing solution when in use. Sufficient sulphite, carbonate and hydroxide should be present so that the working strength developer has a pH within the range of 9.0 to 11.0.

Preferably at least one metal complexing agent is present in the developing solution. A particularly suitable compound is diethylenetriamine pentacetic acid (DTPA). Other suitable metal complexing agents include phosphonic acids such as 1-hydroxyethylidene, 1,1 -diphosphonic acid, diethylenetriamine penta (methylenephosphonic acid), ethylene aliamine tetra (methylene phosphonic acid) and alkali metal salts thereof.

An alkali metal bromide may be present in the developing solution as a stabiliser or antifoggant. An organic stabiliser may also be present.

Water-miscible solvents such as ethylene glycol, diethylene glycol, triethylene glycol, ethylene glycol monomethyl ether and ethylene glycol monoethyl ether may be present as well as amines or ethanolmines. Such compounds may be used to help promote the solubility of the developing agents used or in the case of amines and ethanolamines as buffer promoting additives.

It is to be understood that the developing solution according to the present invention relates to a working strength developing solution. It also relates to powder developing compositions which are required to be dissolved in water, or to concentrated developing solutions which requires dilution with water to give the said working strength solution.

Preferably the amount of compound of formula I present in the working strength developing solution is between 0.00035 and 0.0028 moles per liter. For compound A this is equivalent to 0.1 to about 0.8 grams per liter. For compound A a most preferred quantity is between 0.1 and 0.5 grams per liter.

A particularly preferred developing solution according to the present invention comprises 0.1 to 0.2 g/liter of the compound of formula I, from 2 to 5 g/liter of hydroquinone, and from 0.1 to 1.5 g/liter of the electron transfer agent compound B, together with a base. This developer is suitable for dish processing of photographic paper.

For roller transport machine processing a preferred developing solution according to the present invention comprises 0.2 to 0.6 g/liter of the compound of formula I, from 4 to 12 g/liter of hydroquinone, and from 0.2 to 2.0 g/liter of the electron transfer agent compound B, together with a base.

The accompanying Examples will serve to illustrate the invention.

EXAMPLE I

A ready-to-use silver halide developing solution was prepared of the following formula:

| | |
|---|---|
| Potassium sulphite (65% w/v) | 30 $cm^3$ |
| DTPA $Na_5$ (37% w/v) | 6.8 $cm^3$ |
| Potassium carbonate | 20 g |
| Compound B | 0.4 g |
| Sodium L-ascorbate | 8 g |
| Potassium bromide | 1 g |
| Acetic acid | to pH = 10.30 |
| Water | to 1 liter |

This was developer 1 and it contained no compound of formula I. Developer 2 had the same formulation but it comprised in addition 0.01 g/liter of compound A; developer 3 comprised in addition 0.05 g/liter of compound A; developer 4 comprised in addition 0.1 g/liter of compound A and developer 5 comprised in addition 0.2 g/liter of compound A.

The sensitometric results obtained following dish development for 1 minute at 20° C. followed by stop bath (optional), fixing, washing and drying stages using the same photographic print material for all the developing solutions are set out in Table 1 which follows. In this table:

D min is minimum density;

Ds is 90% of Dmax (maximum density);

Contrast is difference between loge values at Dmin+0.04 and Ds;

Speed is measured at a density of 0.6+Dmin;

'a' is a measure of redness or greenness of an image;

'b' is a measure of blueness or yellowness of an image; and

IT(s) is induction time in seconds–the time elapsing before the photographic image begins to appear.

Thus the 'b' figure is a measure of the image tone. A minus 'b' indicates a cold image thus the greater the minus figure the colder the image tone.

TABLE 1

| DEVELOPER | Dmin | Ds | contrast | speed | 'a' | 'b' | IT(s) |
|---|---|---|---|---|---|---|---|
| 1 | 0.02 | 1.85 | 0.76 | 2.24 | 0.8 | 0.0 | 7.0 |
| 2 | 0.02 | 0.02 | 0.76 | 2.24 | 0.8 | −0.2 | 7.0 |
| 3 | 0.01 | 0.01 | 0.77 | 2.22 | 0.7 | −0.3 | 7.0 |
| 4 | 0.01 | 0.01 | 0.76 | 2.20 | 0.8 | −0.8 | 7.5 |
| 5 | 0.01 | 0.01 | 0.78 | 2.17 | 0.7 | −1.6 | 8.5 |

This shows that the greater the concentration of compound A in the developing solution the greater the cold toning with a level of 0.1 g/liter needed for a good effect. There are essentially no other changes other than a slight increase in induction time at the two highest levels of compound A in the developing solution.

EXAMPLE 2

As the compounds of formula I show some similarities to compounds which have been used as antifoggants in developing solutions, a number of antifoggants were tested in the developer 1, at the same concentration as compound A in developer 4, using the same dish processing method as described in Example 1.

The antifoggants tested in developer 1 were:

Benzotriazole 0.1 g/liter (developer 6).

5-methylbenzotriazole 0.1 g/liter (developer 7).

Anthraquinone-2-sulphonic acid 0.1 g/liter (developer 8).

6-nitrobenzimidazole 0.1 g/liter (developer 9).

The 'b' results after processing the same paper are set forth in Table 2.

TABLE 2

| Developer | 'b' |
|---|---|
| 4 | −0.8 |
| 6 | −0.4 |
| 7 | −0.4 |
| 8 | −0.3 |
| 9 | 0.2 |

This shows that the first three anti-foggants listed above show some cold toning effect but none of them is as effective as compound A.

EXAMPLE 3

A ready to use silver halide developing solution was prepared of the following formula:

| | |
|---|---|
| Potassium sulphite (65% w/v) | 30 $cm^3$ |
| DTPA $Na_5$ (37% w/v) | 6.8 $cm^3$ |
| Potassium carbonate | 20 g |
| Hydroquinone | 3.5 g |
| Compound B | 0.3 g |
| Potassium bromide | 0.4 g |
| Potassium hydroxide | 2.5 g |
| Water to | 1 Liter |
| pH = | 10.80 |

This was developer 10 and it contained no compound of formula I.

Developer 11 had the same formulation but it comprised in addition 0.05 g/liter compound A, developer 12 comprised in addition 0.1 g/liter compound A, developer 13 comprised in addition 0. 15 g/liter compound A, developer 14 comprised in addition 0.20 g/liter compound A and developer 15 comprised in addition 0.25 g/liter compound A.

The sensitometric results obtained using the same dish processing method described in Example 1 using the same photographic print material for all the developing solutions are set out in Table 3 which is as follows:

Sensitometric parameters are as in Table 1.

TABLE 3

| DEVELOPER | Dmin | Ds | contrast | speed | 'a' | 'b' | IT(s) |
|---|---|---|---|---|---|---|---|
| 10 | 0.00 | 1.87 | 0.90 | 2.31 | 0.5 | +0.3 | 9.0 |
| 11 | 0.00 | 1.87 | 0.87 | 2.27 | 0.7 | −0.5 | 10.0 |
| 12 | 0.00 | 1.88 | 0.87 | 2.23 | 0.6 | −0.8 | 12.0 |
| 13 | 0.00 | 1.88 | 0.88 | 2.18 | 0.6 | −1.1 | 12.5 |
| 14 | 0.00 | 1.89 | 0.90 | 2.17 | 0.6 | −1.5 | 14.0 |
| 15 | 0.00 | 1.86 | 0.89 | 2.12 | 0.5 | −1.9 | 16.0 |

This shows that the greater the concentration of compound A in the developing solution the greater the cold toning with a level of 0.1 g/liter needed for a good effect.

EXAMPLE 4

A ready to use silver halide developing solution was prepared to the following formula:

| | |
|---|---|
| Potassium sulphite (65% w/v) | 60 $cm^3$ |
| DTPA $Na_5$ (37% w/v) | 6.8 $cm^3$ |
| Potassium carbonate | 25 g |
| Compound B | 0.9 g |
| Hydroquinone | 9 g |
| Potassium bromide | 2 g |
| Potassium hydroxide | ->pH 10.60 |
| Water | ->1 L |

This was developer 16 and it contained no compound at formula I. Developer 17 was much the same formulation but it comprised in addition 0.2 $gl^{-1}$ compound A, developer 18 comprised in addition 0.4 $gl^{-1}$ compound A, developer 19 comprised in addition 0.6 $gl^{-1}$ compound A, developer 20 comprised in addition 0.8 $gl^{-1}$ compound A and developer 21 comprised in addition 1.0 $gl^{-1}$ compound A.

The sensitometric results obtained following roller transport machine development for 16 seconds at 35° C. followed by fixation, washing and drying stages using the same photographic print material for all of the developing solutions as set out in Table 4.

TABLE 4

| DEVELOPER | Dmin | Ds | contrast | speed | 'a' | 'b' |
|---|---|---|---|---|---|---|
| 16 | 0.00 | 1.78 | 0.89 | 2.26 | 0.7 | −0.4 |
| 17 | 0.00 | 1.79 | 0.90 | 2.19 | 0.8 | −0.9 |
| 18 | 0.00 | 1.81 | 0.91 | 2.17 | 0.8 | −1.2 |
| 19 | 0.00 | 1.81 | 0.90 | 2.14 | 0.4 | −1.5 |
| 20 | 0.00 | 1.81 | 0.93 | 2.11 | 0.4 | −1.7 |
| 21 | 0.00 | 1.80 | 0.98 | 2.10 | 0.5 | −1.9 |

This shows that the greater the concentration of compound A in the developing solution the greater the cold toning with a level of around 0.6 $gl^{-1}$ being most useful. Whilst higher concentrations of compound A produced a greater cold toning effect there was an unacceptable loss of contrast. The additive of compound A also caused a loss of speed but this could be compensated for by adjusting exposure time.

Therefore, although the invention has been described with respect to illustrations and examples thereof it is not to be limited to those because it is considered that one skilled in the art will be able to utilize substitutes and equivalents to make such compositions without departing from the scope and spirit of the invention as defined in the claims appended hereto.

We claim:

1. A photographic developing solution which is characterised in that it comprises as an image toning agent a compound of formula I:

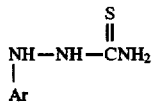

I where Ar is a phenyl ring which is substituted with a water solubilizing group selected from the group consisting essentially of a carboxylic acid group, a sulphonic acid group or a salt thereof, in a concentration of at least 0.00035 moles/liter.

2. A photographic developing solution according to claim 1 wherein the compound of formula I is of formula II:

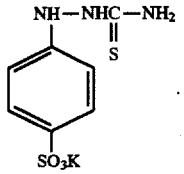

II

3. A photographic developing solution according to claim 1 wherein the main developing agent in the solution is a dihydroxybenzene type developing agent.

4. A photographic developing solution according to claim 1 wherein the main developing agent in the solution is a reductone type developing agent.

5. A photographic developing solution according to claim 4 wherein the reductone type developing agent is L-ascorbic acid, D-isoascorbic acid or L-erythroascorbic acid or salts of such compounds.

6. A photographic developing solution according to claim 3 wherein the amount of the dihydroxybenzene type developing agent present in the working strength developing solution is from 1 to 15 g/liter.

7. A photographic developing solution according to claim 1 wherein there is also present in the developing solution an electron transfer agent.

8. A photographic developing solution according to claim 7 wherein the electron transfer agent is metol or a pyrazolidinone compound of the general formula V:

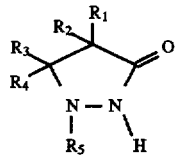

V in which $R_5$ is an aromatic ring; $R_1$ and $R_2$ are hydrogen, lower alkyl, or hydroxy alkyl, and $R_3$ and $R_4$ are hydrogen, lower alkyl or phenyl.

9. A photographic developing solution according to claim 1 wherein the amount of the compound of formula I present in the solution is from 0.1 to 0.5 g/liter.

10. A photographic developing solution according to claim 9 for roller transport machine processing wherein the amount of compound of formula I present in the solution is from 0.2 to 0.6 g/liter, the amount of hydroquinone is from 4 to 12 g/liter, and the amount of electron transfer agent compound B is from 0.2 to 2.0 g/liter, together with a base.

11. A photographic developing solution according to claim 9, for dish processing, wherein the amount of compound of formula I present in the solution is from 0.1 to 0.2 g/liter, the amount of hydroquinone is from 2 to 5 g/liter, and the amount of electron transfer agent compound B is from 0.1 to 1.5 g/liter, together with a base.

* * * * *

UNITED STATES PATENT AND TRADEMARK OFFICE

CERTIFICATE OF CORRECTION

PATENT NO. : 5,688,635

DATED : November 18, 1997

INVENTOR(S) : Parker et al.

It is certified that error appears in the above-indentified patent and that said Letters Patent is hereby corrected as shown below:

at Col. 2 line 17 delete "taummeric" and insert - tautomeric -.

Col. 3 line 44 delete "aliamine" and insert - diamine -.

Signed and Sealed this

Thirty-first Day of March, 1998

Bruce Lehman

*Attest:*

BRUCE LEHMAN

*Attesting Officer*

*Commissioner of Patents and Trademarks*